US010694906B2

(12) United States Patent
Courtney et al.

(10) Patent No.: US 10,694,906 B2
(45) Date of Patent: Jun. 30, 2020

(54) HAND DRYER

(71) Applicant: Dyson Technology Limited, Wiltshire (GB)

(72) Inventors: Stephen Benjamin Courtney, Gloucester (GB); Kevin John Simmonds, Bath (GB); Kondwani Bob Kanjere, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 39 days.

(21) Appl. No.: 15/973,411

(22) Filed: May 7, 2018

(65) Prior Publication Data

US 2018/0317721 A1 Nov. 8, 2018

(30) Foreign Application Priority Data

May 8, 2017 (GB) ..... 1707329.7

(51) Int. Cl.
*A47K 10/48* (2006.01)

(52) U.S. Cl.
CPC ..... *A47K 10/48* (2013.01)

(58) Field of Classification Search
CPC ..... A47K 10/48; F26B 19/00; F26B 21/004
USPC ..... 34/202
See application file for complete search history.

(56) References Cited

U.S. PATENT DOCUMENTS 8,136,262 B2 * 3/2012 Collins ..... A47K 10/48 34/105
8,201,344 B2 6/2012 Sawabe
D672,091 S * 12/2012 Dyson ..... D28/54.1
8,490,291 B2 * 7/2013 Churchill ..... A47K 10/48 222/1
8,607,472 B2 * 12/2013 Ishii ..... A47K 10/48 15/97.1
8,850,713 B2 * 10/2014 Nakamura ..... A47K 10/48 132/73
9,057,560 B2 * 6/2015 Dyson ..... F26B 21/004
(Continued)

FOREIGN PATENT DOCUMENTS

CN 105832236 A 8/2016
CN 205866678 1/2017
(Continued)

OTHER PUBLICATIONS

International Search Report dated Jun. 8, 2018, directed to International Application No. PCT/GB2018/050796; 12 pages.
(Continued)

*Primary Examiner* — Stephen M Gravini
(74) *Attorney, Agent, or Firm* — Morrison & Foerster LLP

(57) ABSTRACT

A hand dryer comprising an elongate air-knife discharge outlet for discharging an air-knife across the width of a user's hand held flat in front of the outlet, thereby mechanically to scrape water from the hand as the hand is moved lengthwise relative to the air-knife. The elongate air-knife discharge outlet comprises a straight section for facing the palm or back of the user's hand and a curved, wrap-around end section for extending at least part way around one of the sides of the user's hands. The geometry of the air-knife discharge outlet creates a flow profile which targets the side of the hand with a relatively high-velocity jet of air effective in particular for drying the area around the thumb of a user.

8 Claims, 10 Drawing Sheets

(56) References Cited

U.S. PATENT DOCUMENTS

| | | | | |
|---|---|---|---|---|
| 9,060,657 | B2 * | 6/2015 | Ryan | A47K 10/48 |
| 9,441,885 | B2 * | 9/2016 | Bayley | A47K 4/00 |
| D776,350 | S * | 1/2017 | Gammack | D28/54.1 |
| D776,351 | S * | 1/2017 | Gammack | D28/54.1 |
| 9,743,813 | B2 * | 8/2017 | Courtney | A47K 10/48 |
| 9,743,814 | B2 * | 8/2017 | Ryan | F26B 25/06 |
| 9,986,877 | B2 * | 6/2018 | Steele | A47K 10/48 |
| 10,006,711 | B2 * | 6/2018 | Gammack | A47K 10/48 |
| 10,018,417 | B2 * | 7/2018 | Turrini-Rochford | A47K 10/48 |
| 2013/0042494 | A1 | 2/2013 | Hsu | |
| 2013/0097885 | A1 | 4/2013 | Dyson et al. | |
| 2015/0351593 | A1 | 12/2015 | Schless | |
| 2018/0317721 | A1 * | 11/2018 | Courtney | A47K 10/48 |

FOREIGN PATENT DOCUMENTS

| | | | | |
|---|---|---|---|---|
| DE | 2018695 | | 10/1971 | |
| EP | 2399496 | A1 * | 12/2011 | A47K 10/48 |
| EP | 2 554 085 | | 2/2013 | |
| EP | 2 839 768 | | 2/2015 | |
| EP | 2 744 380 | | 7/2015 | |
| GB | 2 428 569 | | 2/2007 | |
| GB | 2505863 | | 3/2014 | |
| GB | 2562234 | A * | 11/2018 | A47K 10/48 |
| JP | 11-113794 | | 4/1999 | |
| JP | 4207911 | | 1/2009 | |
| JP | 2013-85961 | | 5/2013 | |
| JP | 2018187391 | A * | 11/2018 | A47K 10/48 |
| KR | 10-2007-0082683 | | 8/2007 | |
| WO | 2009/011198 | | 1/2009 | |
| WO | 2012/175860 | | 12/2012 | |
| WO | 2013/114056 | | 8/2013 | |
| WO | WO-2018206910 | A1 * | 11/2018 | A47K 10/48 |

OTHER PUBLICATIONS

Search Report dated Oct. 23, 2017, directed to GB Application No. 1707329.7; 2 pages.

Notification of Reason for Rejection dated Mar. 25, 2019, directed to JP Application No. 2018-089096; 8 pages.

Notification of Reason for Rejection dated Dec. 16, 2019, directed to JP Application No. 2018-089096; 5 pages.

* cited by examiner

HAND DRYER

REFERENCE TO RELATED APPLICATIONS

This application claims the priority of United Kingdom Application No. 1707329.7, filed May 8, 2017, the entire contents of which are incorporated herein by reference.

FIELD OF THE INVENTION

The present invention relates to a hand dryer.

BACKGROUND OF THE INVENTION

Hand dryers are often installed in public washrooms as an alternative to paper towels.

There are three main types of hand dryer on the market: "warm-air" hand dryers, "high speed" hand dryers and "air-knife" hand dryers.

Warm air hand dryers are very well known. They are invariably low flow, low speed machines which rely on heating the air to promote an evaporative drying effect at the surface of the hand. Examples include the Model-A Series of hand dryers manufactured and marketed by World Dryer Corporation, which is illustrated in FIG. 1. The heated airflow is typically discharged through a single nozzle a and the drying action is a "hand-over-hand" action, requiring the user to rub the hands together under the nozzle a with the aim of encouraging the evaporative drying effect.

High speed hand dryers, as the name suggests, use high speed airflow (>80 m/s) to provide a momentum-drying effect at the surface of the hands. Examples include the Xlerator® hand dryer manufactured and marketed by Excel Dryer Inc. and the Airforce manufactured by World Dryer Corporation. Again the airflow is typically discharged through a single relatively large nozzle—or a cluster of smaller nozzles—and the mode of use is somewhat similar to the "hand-over-hand" action of the warm air dryer, with the hands being held or cupped together underneath the nozzle to dry them. However, instead of being evaporated, the majority of the water on the surface of the hands is instead driven or blasted from the hands by the high-momentum airflow. The airflow tends not to be heated, though waste heat from the motor may in some cases be used to heat the airflow to a degree.

The third general type of hand dryer is the air-knife hand dryer, examples of which include the Dyson Airblade range of hand dryers manufactured by Dyson (UK) Limited and the Jet Towel range of hand dryers manufactured by Mitsubishi Electric Corporation.

Air-knife hand dryers use an "air-knife"—effectively a sheet or curtain of fast-moving air—which moves across the surface of the hand and, as it does so, removes water mechanically by scraping or stripping the water from the surface of the hand.

In certain models of Dyson Airblade hand dryer—and also in the Mitsubishi Jet Towel range of hand dryers—two opposing, stationary air-knives are used: one for each side of the user's hand. The hands are inserted between the air-knives and then withdrawn slowly to effect the required relative movement between the hands and the air knives.

In the Mitsubishi arrangement—shown in FIG. 2—the air-knife is discharged through opposing rows of individual discharge apertures (only the rear row b is visible in FIG. 2): here, the individual jets combine to produce the air knife downstream of the discharge apertures.

In the Dyson arrangement—which is described in UK Patent No. GB2428569 (hereafter, GB2428569) and reproduced in FIG. 3—the air knives are instead discharged through narrow, continuous slots (only the rear slot c is visible in FIG. 1), each less than 1 mm wide. The slots are ergonomically designed to mirror the anatomic shape of the user's hands. Thus, the front slot is straight to reflect the relatively flat palms of the user's hands and the rear slot c incorporates a pair of concave portions intended to conform better to the slightly-rounded back of the user's hand.

Later models of Dyson Airblade hand dryer—one of which is described in European Patent No. EP2744380 (hereafter, EP2744380) and reproduced in FIG. 4—provide a single-sided air-knife drying action and the user dries the hands one side at a time. Again, the air-knives (one for each hand) are discharged each through a narrow, continuous slot e less than 1 mm wide.

SUMMARY OF THE INVENTION

The present invention seeks to provide an improved air-knife hand dryer, in particular one having an improved air-knife outlet design.

According to the present invention, there is provided a hand dryer, the hand dryer comprising a nozzle, the nozzle comprising an elongate air-knife discharge outlet for discharging an air-knife across the width of a user's hand held flat in front of the outlet, thereby mechanically to scrape water from the hand as the hand is moved lengthwise relative to the air-knife, the nozzle comprising a straight part for facing the palm or back of the user's hand, the nozzle comprising a curved wrap-around end part for extending at least part way around the side of the user's hand, the elongate air-knife discharge outlet extending along the straight part of the nozzle and around the curved end part of the nozzle.

The geometry of the air-knife discharge outlet in accordance with the invention has been found to create a flow profile which targets the side of the hand with a relatively high-velocity jet of air. This high-velocity jet of air—which arises from the interaction of the air exiting the straight part with the air exiting the curved end part—is particularly effective for drying the area around the thumb of a user, which has often been a problem-area in prior art air-knife hand dryers: even those such as the one described in GB2428569 which utilise ergonomically-designed nozzles.

The nozzle may comprise two curved wrap-around end parts: one at each end of the straight part of the nozzle. In this arrangement, the discharge outlet may extend around both the curved end parts of the nozzle. This provides better drying of both sides of the user's hand rather than just one preferential side. In any event, the overall length of the nozzle, measured between the curved ends, is preferably between 100 and 150 mm for encouraging the user to hold the fingers of the hand closer together rather than splayed open. Thus, the wrap-around curved ends of the outlet—and the length of the straight section—combine to encourage a more closed hand position, which has the benefit of further reducing dry-time.

The radius of curvature of the curved end(s) is preferably in the range 5-50 mm.

The angle subtended by the curved end(s) is preferably in the range 45-90 degrees.

In a preferred embodiment, two such air-knife outlets are provided, one for each hand. The air-knife outlets may be arranged in a V-configuration when viewed from the front of the hand dryer.

The elongate discharge outlet may be a continuous slot less than 1 mm in width.

BRIEF DESCRIPTION OF THE DRAWINGS

Embodiments of the invention will now be described with reference to the accompanying drawings, in which.

DETAILED DESCRIPTION OF THE INVENTION

Figure 1:
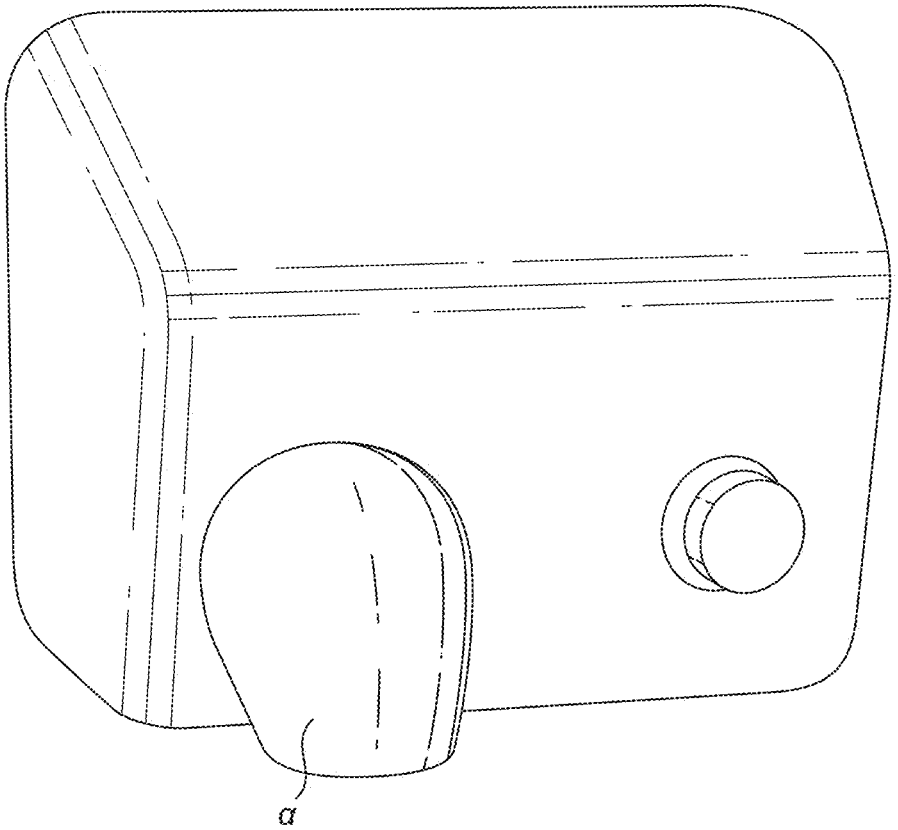
FIG. 1 (PRIOR ART)
FIGS. 1-4 are perspective views of four different conventional hand dryers.
Figure 2:
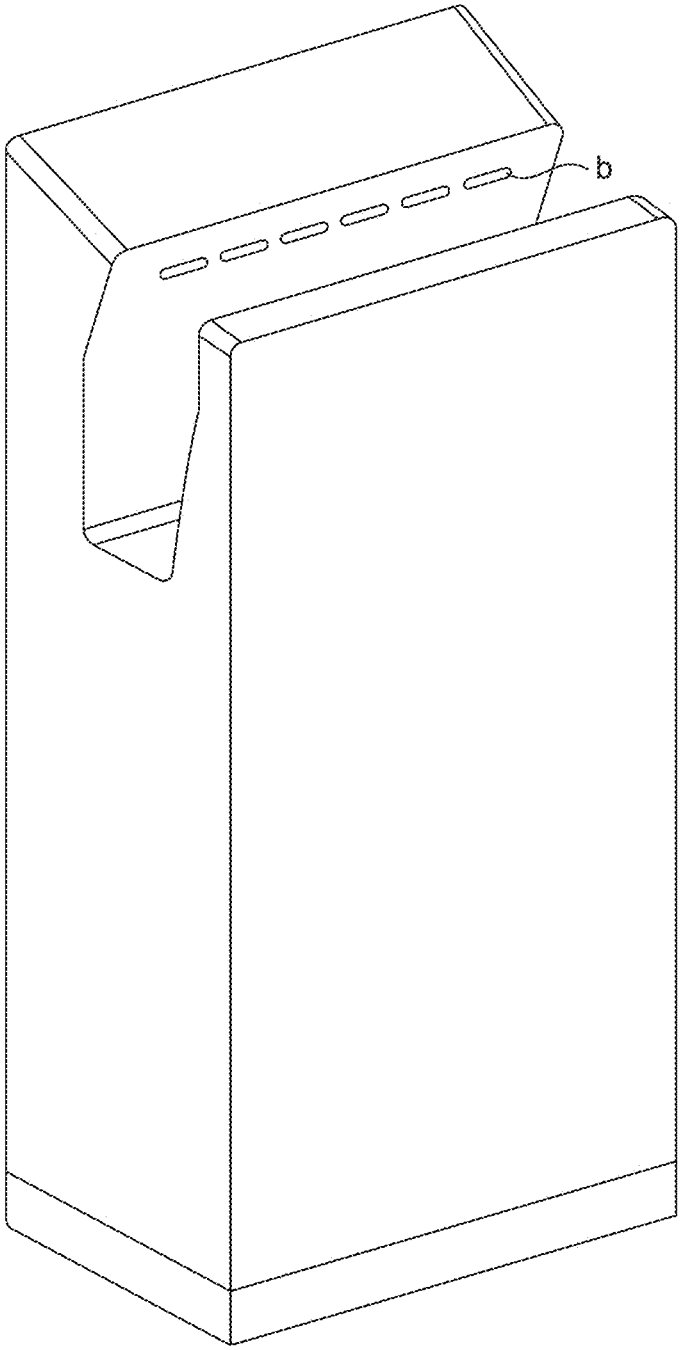
FIG. 2 (PRIOR ART)
Figure 3:
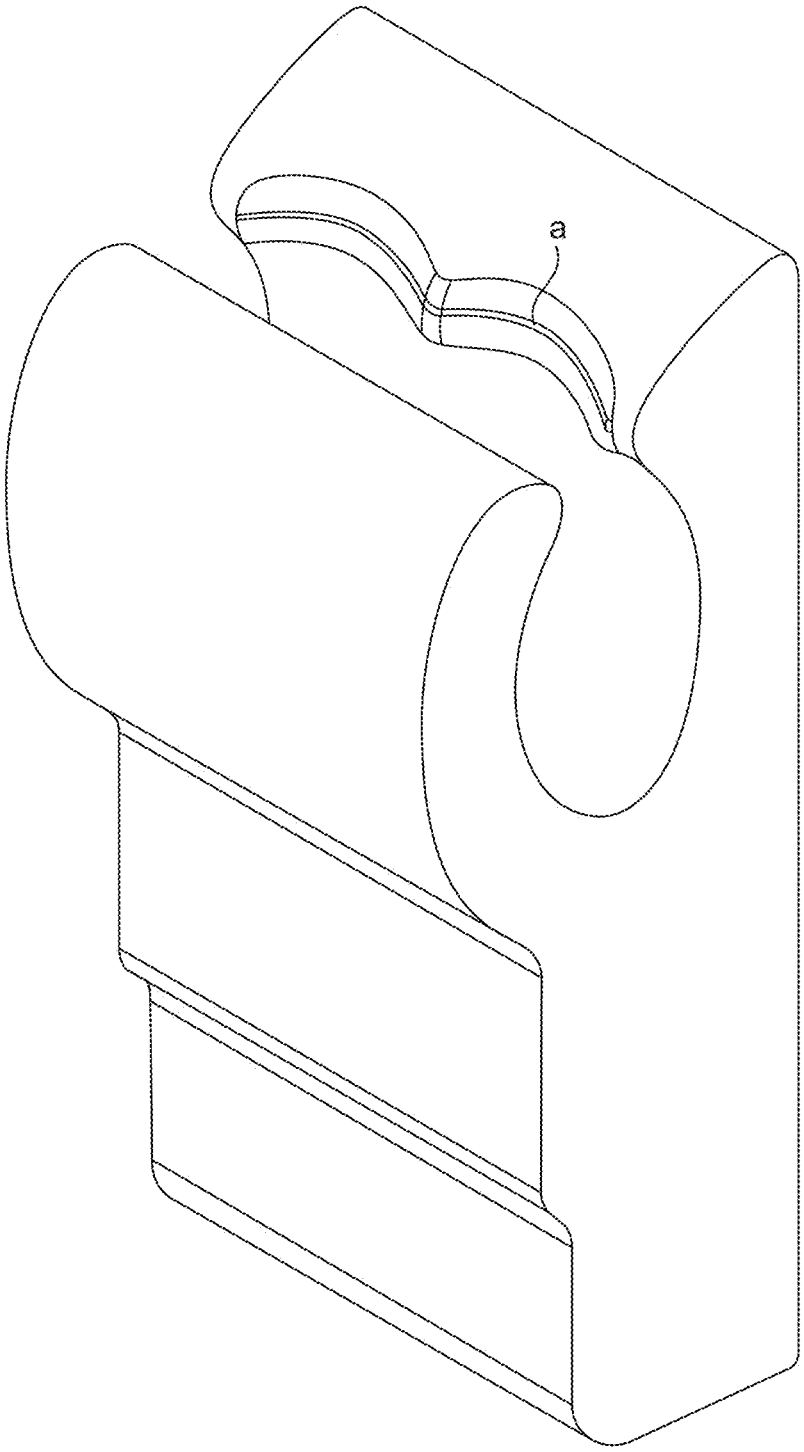
FIG. 3 (PRIOR ART)
Figure 4:
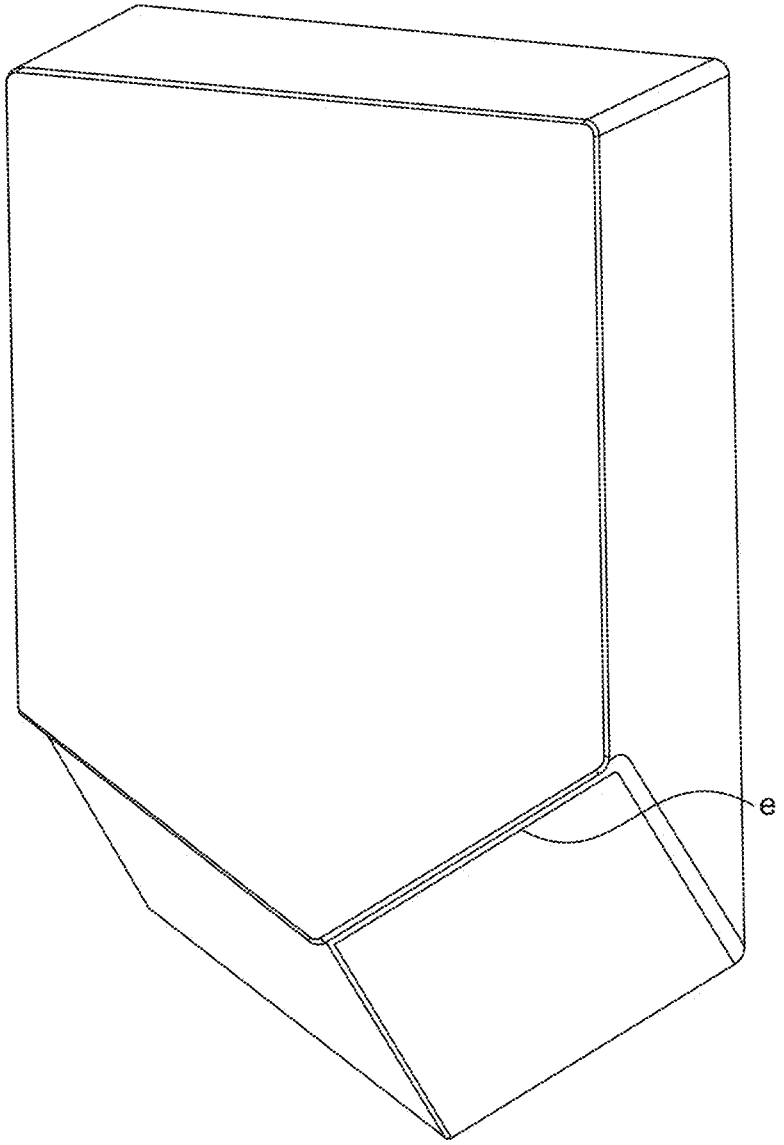
FIG. 4 (PRIOR ART)
Figure 5:
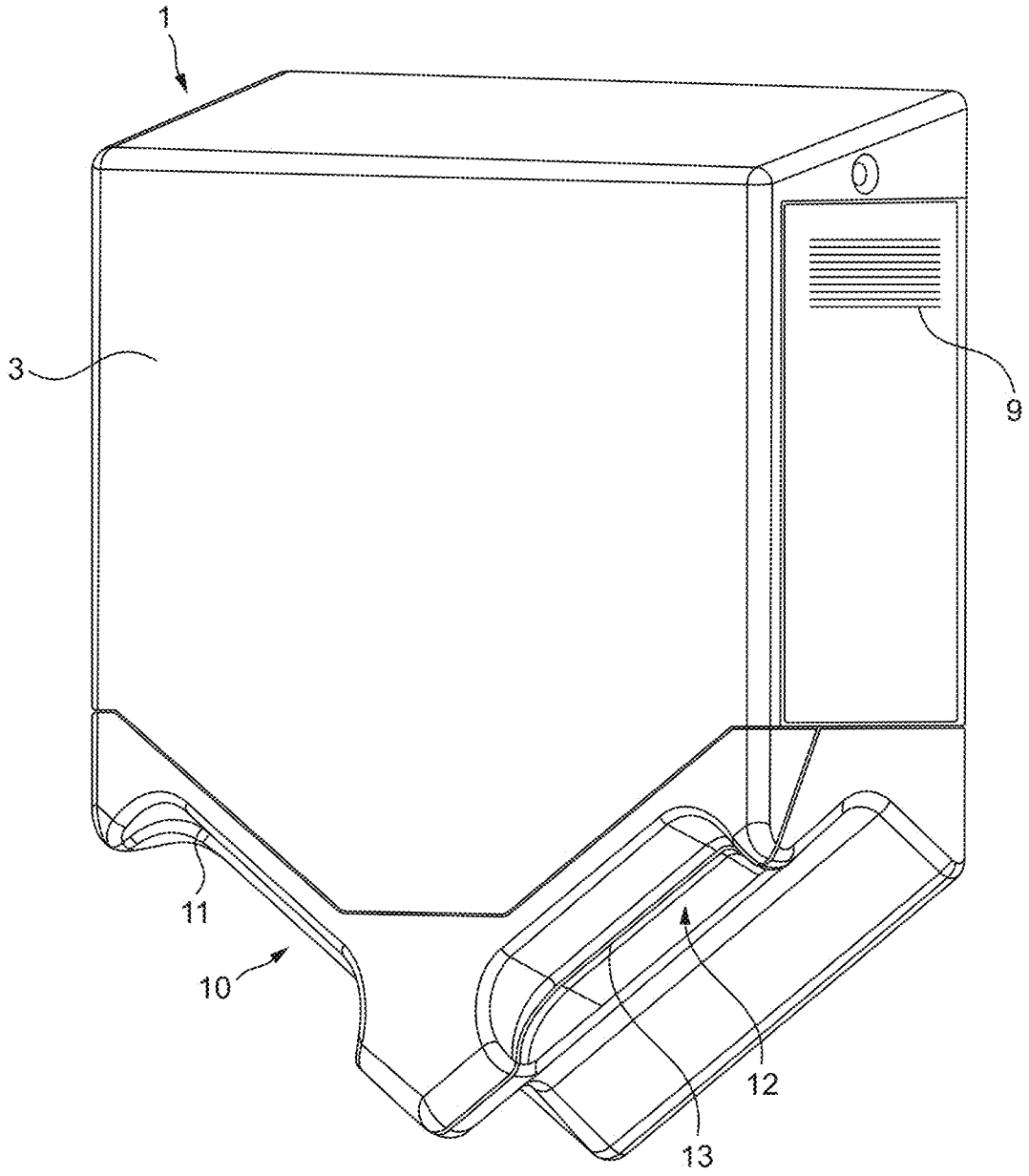
FIG. 5 is a perspective view of a hand dryer according to the present invention.
Figure 6:
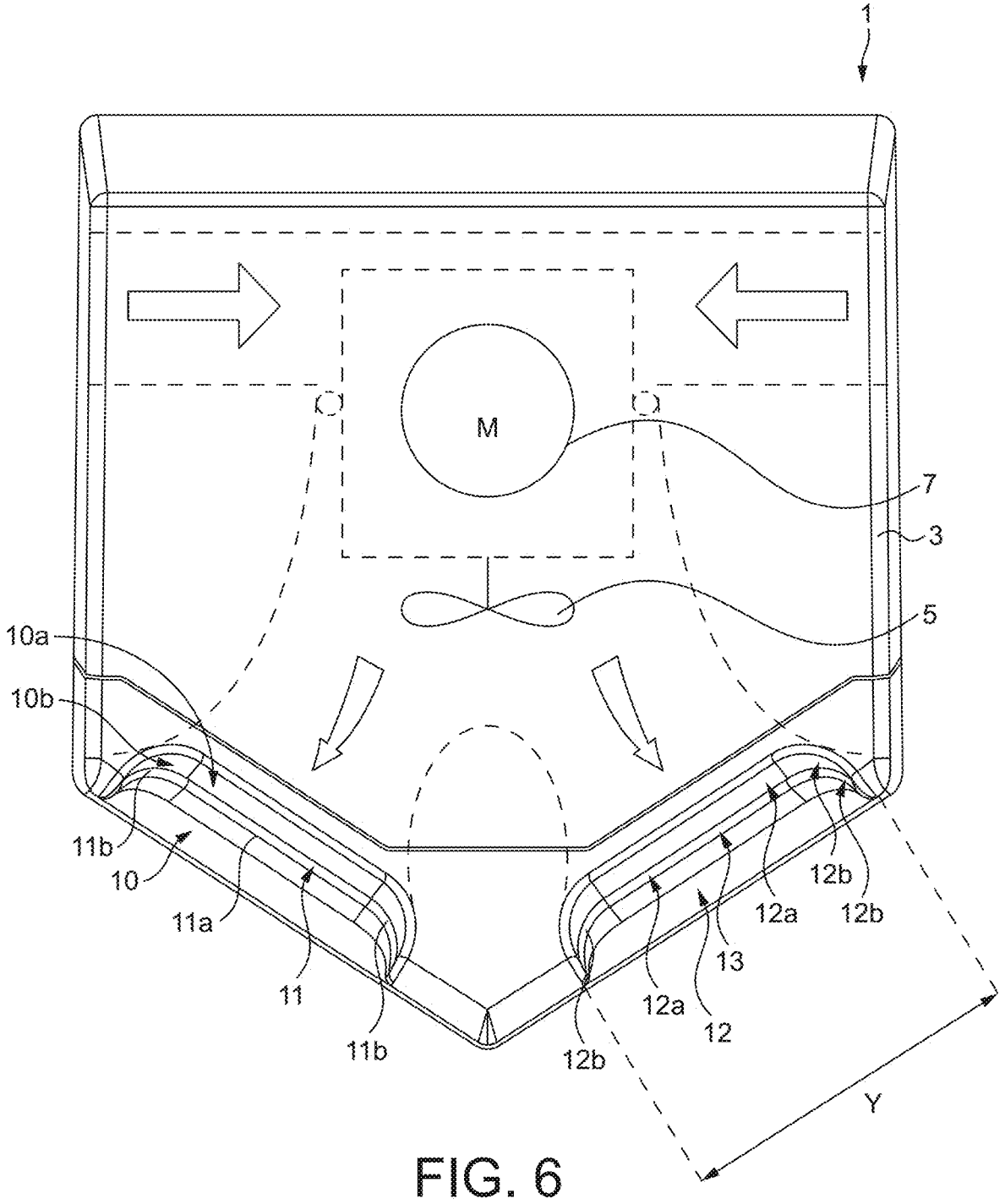
FIG. 6 is a front view of the hand dryer shown in FIG. 5, illustrating schematically some of the internal components of the hand dryer.

FIG. 5 shows a wall-mountable hand dryer 1, here illustrated in its normal wall-mounted orientation. FIG. 6 shows the principal interior components of the hand dryer 1, in highly schematic form viewed from the front of the hand dryer.

The basic configuration of the hand dryer 1 is similar to the hand dryer described in EP2744380. The hand dryer 1 comprises a main casing 3, which houses a ducted fan 5. A motor 7 is provided inside the main casing 3 to drive the fan 5, which draws air through the intakes 9 on either side of the main casing 3 (only one intake 9 is visible in FIG. 5) and forces the air at high speed ((>100 m/s) out through two nozzles: a left-hand nozzle 10 on the left-hand side of the dryer and a right-hand nozzle 12 on the right-hand side of the dryer.

Each nozzle comprises a respective discharge outlet 11, 13 positioned on an underside of the dryer 1. The discharge outlets 11, 13 run along a front lower edge of the main casing 3 so that they are spaced from the wall.

The discharge outlets 11, 13 each comprise a continuous slot—less than 1 mm in width—arranged so that it runs generally plane-parallel with the wall. Because the discharge outlets 11, 13 are very thin the drying air is discharged at high speed in the form of a thin sheet or curtain of air: a so-called "air-knife".

In use, the hands are inserted lengthwise front-to-back underneath the discharge outlets 11, 13 and the air-knives are directed down onto the hands to 'scrape' water from the hands as they are subsequently withdrawn underneath the discharge outlets 11, 13.

The hands are dried one side at a time, in similar manner to the hand dryer in EP2744380: first, the user passes his (or her) hands forth and back underneath the discharge outlets 11, 13 with the palm facing up towards the discharge outlets (the "standard pass"). Then—after turning over the hands—the user passes his (or her) hands forth and back underneath the discharge outlets 11, 13 with the back of the hands facing up towards the discharge outlets (the "reverse pass"). The "standard pass" and "reverse pass" may each be repeated, as required, and carried out in any order.

A conventional sensor arrangement (not shown) can be used to turn on the motor 7 in response to the detection of a user's hands. The same sensor arrangement may be used subsequently to turn the motor 7 off in response to a null detection, or else the motor 7 may be operated on a timer. Use of a sensor arrangement is not essential: the dryer 1 may alternatively be arranged for manual operation.

The air-knife discharge outlets 11, 13 are arranged in a V-configuration when viewed from the front of the dryer. This is intended to make the dryer more comfortable to use by allowing the user to bank his hands accordingly during both the standard pass and the reverse pass—similar to the manner described in EP2744380.

The hand dryer differs from the one described in EP2744380 in relation to the geometric profile of the air-knife discharge outlets 11, 13.

In the hand dryer described in EP2744380 the discharge outlets are straight. In the hand dryer 1, however, the discharge outlets 11, 13 are not straight. Instead, the nozzles 10, 12 each comprise a straight part 10*a*, 12*a* and two curved, wrap-around end parts 10*b*, 12*b* and the discharge outlets 11, 13 likewise comprise a straight part 11*a*, 13*a*—extending along the straight part of the respective nozzle 10, 12—and two curved, wrap-around end parts 11*b*, 13*b*: which extend around the respective curved end parts of the nozzles 10, 12.

The straight sections 11*a*, 13*a* of the discharge outlets 11, 13 are each arranged for facing the palm or back of the user's respective hand (in this case, depending upon whether the user is engaging in a 'standard pass' or a 'reverse pass'). The curved, wrap-around end sections 11*b*, 13*b* are arranged for extending at least part way around a respective side of the hand.

The geometry of each of the air-knife discharge outlets 11, 13 creates a flow profile which targets the sides of the hand with a relatively high-velocity jet of air. This is illustrated in FIGS. 7 and 8

Figure 7:
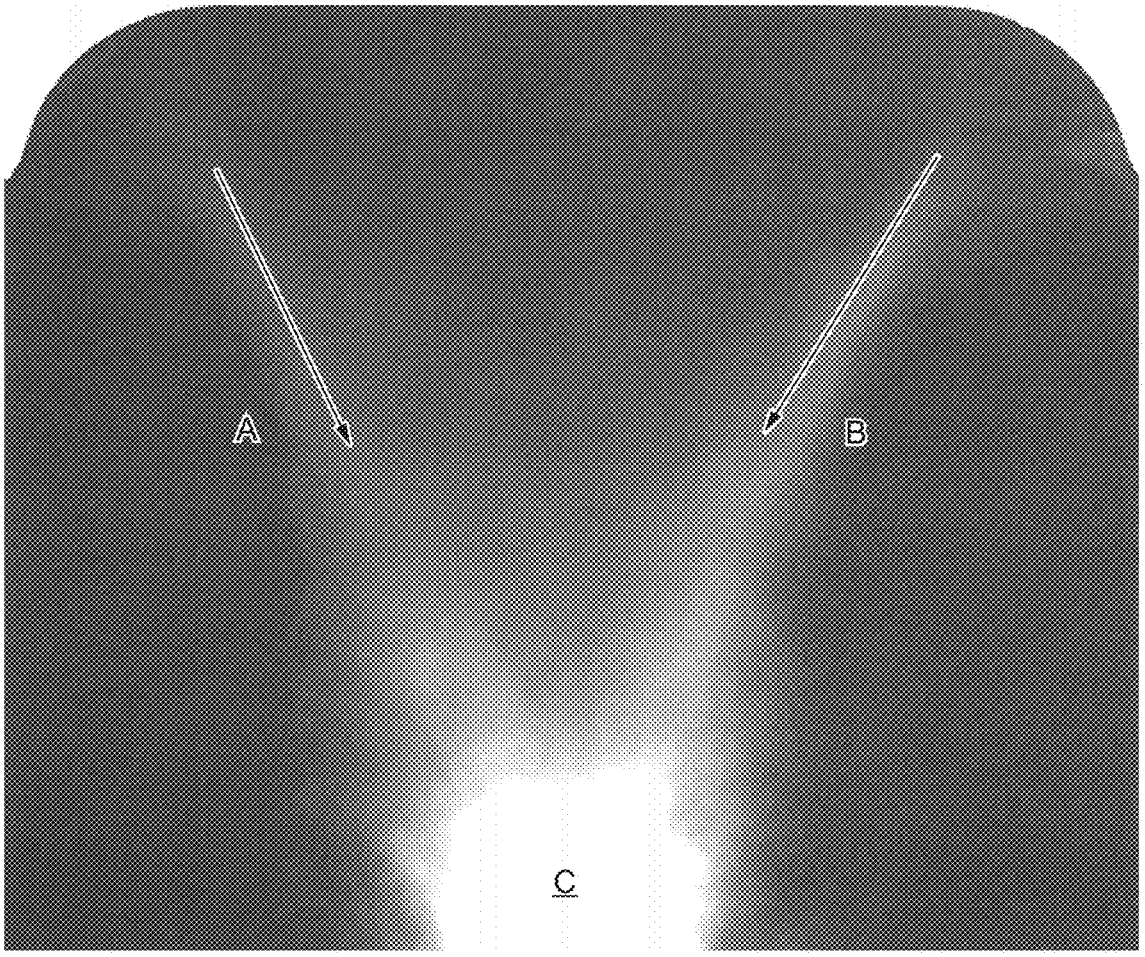
FIG. 7 is a photographic image of a discharge outlet in accordance with the invention, illustrating the flow profile created by the discharge outlet.
Figure 8:
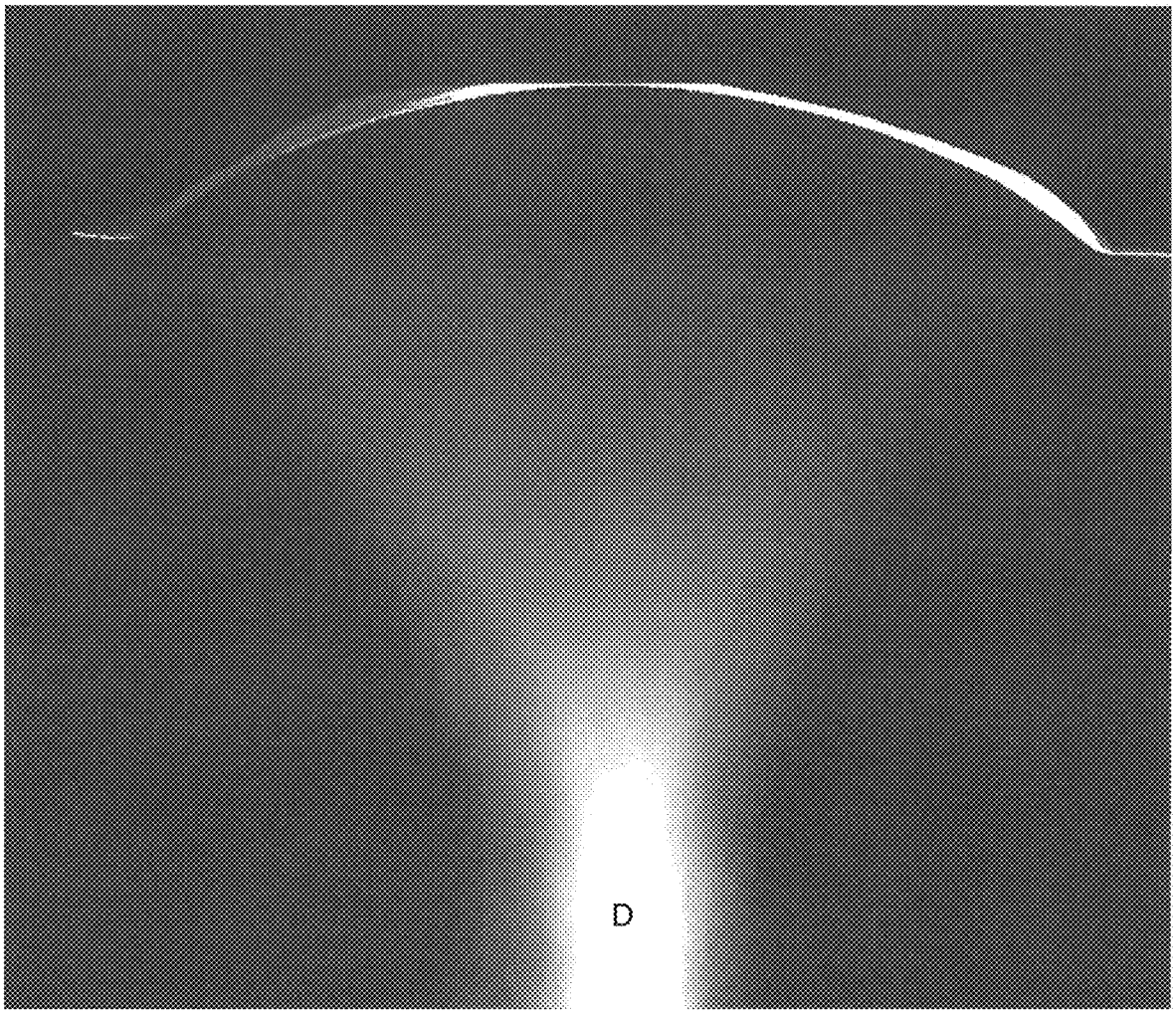
FIG. 8 is a photographic image of a conventional air-knife nozzle, illustrating the flow profile created by the nozzle.

The images shown in FIGS. 7 and 8 were each created using an oil-based smoke machine to blow smoke through the discharge outlet. The discharge outlet was located in a dark room and the air and smoke exiting the slot was illuminated using a halogen bulb. The image was captured using a conventional digital camera.

The image in FIG. 7 is of a discharge outlet 11. It shows two distinct high-velocity jets of air—labelled A and B: one associated with each of the two curved ends 11*b* of the outlet 11. These localised, high-velocity regions converge at a central region C in front of the discharge outlet.

By way of comparison, the image in FIG. 8 is of a conventional curved nozzle which is shaped anatomically to follow the back of a user's hand: such as might be found on a conventional hand dryer like the one described in GB2428569. Here, there are no pronounced, localised high-velocity regions within the airflow; instead, the airflow velocity is uniform and the airflow converges at a single focal point, D determined by the radius of curvature of the nozzle.

It is thought that the high-velocity jets of air observed in FIG. 7 are created at least in part by the local interaction of airflows exiting different parts of the discharge outlet in the region of the curved ends.

In practice, the interaction is complex: but it can be visualised in simplified terms as the vector addition of component airflows.

FIGS. 9 to 12 serve to illustrate the point.

Figure 9:
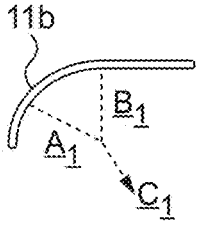
FIG. 9 is a schematic view of one end of a discharge outlet in accordance with the invention, illustrating interaction between an airflow exiting the curved end of the outlet and an airflow exiting the straight section of the outlet.
Figure 10:
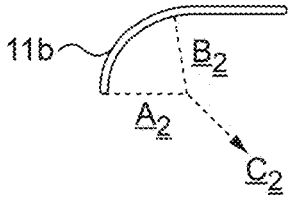
FIG. 10 is a schematic view corresponding to FIG. 9, but illustrating interaction between airflows exiting different parts of the curved end.
Figure 11:
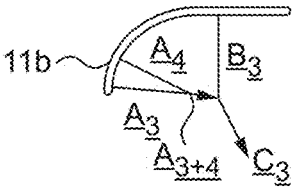
FIG. 11 is a schematic view corresponding to FIGS. 9 and 10, illustrating interaction between airflows exiting different parts of the curved end and subsequent interaction of the resultant airflow with an airflow exiting the straight section of the discharge outlet.
Figure 12:
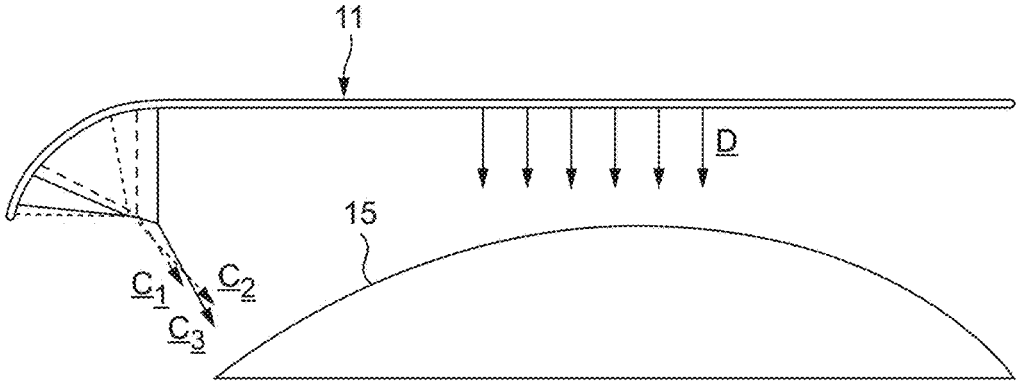
FIG. 12 is a schematic view of the discharge outlet incorporating the end of the discharge outlet shown in FIGS. 9-11, illustrating the net effect of the interactions depicted in FIGS. 9-11.

FIGS. 9 to 11 show the same (single) curved end 11*b* of the discharge outlet 11. In FIG. 9, a first airflow $A_1$ is shown exiting the curved end 11*b*. This first airflow $A_1$ interacts with a second airflow $B_1$ exiting the straight middle section in the region of the curved end. The two airflows $A_1$ and $B_1$ combine to create a higher-speed resultant airflow $C_1$, where $C_1=(A_1^2+B_1^2+2A_1B_1 \cos \theta_1)^{1/2}$. In FIG. 10, an airflow $A_2$ is shown exiting a first part of the curved end. This airflow then interacts with an airflow $B_2$ exiting a second part of the same curved end. Again, the two airflows $A_2$ and $B_2$ combine to create a higher-speed, resultant airflow, $C_2$. In FIG. 11, two airflows $A_2$ and $A_4$ are shown exiting different parts of the curved end, which combine to produce an airflow $A_{3+4}$. The airflow $A_{3+4}$ then interacts with an airflow $B_3$ exiting the straight middle section of the slot to create a higher-speed resultant airflow $C_3$. The net result of each of these interactions is to create a resultant, relatively high-speed, localised region of airflow which is directed in towards the sides of the user's hand 15, as shown in FIG. 12. This represents the high-velocity jet of air A observed in FIG. 7, which targets the sides of the user's hands.

By contrast, in the region of the straight section of the discharge outlet, away from the curved ends, the airflow D is discharged uniformly straight and square-on to the user's hand 15 and there is no significant interaction between adjacent regions of the airflow D in the manner illustrated in FIGS. 9 to 11. Consequently, the flow profile in this region is generally uniform and the local air speeds are generally lower than in the high velocity jets of air targeting the sides of the hand. In effect, the geometry of the discharge outlet 11 creates localised high-velocity airflow regions only where they are required in order to provide an increased drying effect, not across the entire discharge outlet 11.

Figure 13:
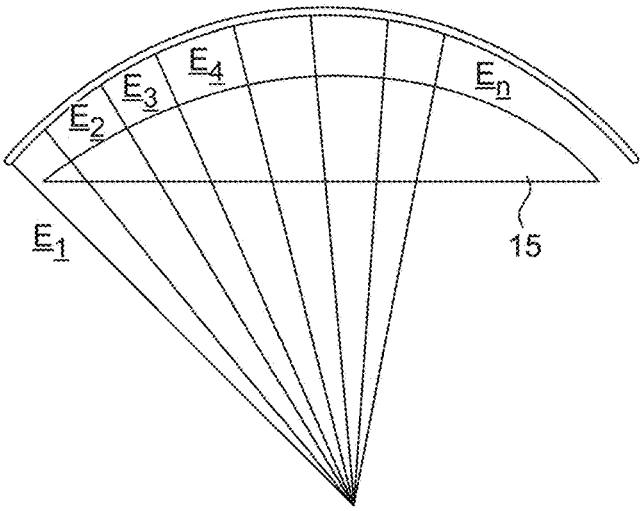
FIG. 13 (PRIOR ART)
FIG. 13 is a schematic view of a conventional air-knife nozzle, illustrating convergence of the airflow to a point behind the user's hand.

FIG. 13 shows a comparative illustration of a curved air-knife nozzle such as might be found on a conventional hand dryer like the one described in GB2428569.Here, the airflows $E_1 \ldots E_n$ converge to a 'focal point' behind the user's hand 15 when the user's hand 15 is placed next to the nozzle. Consequently, there is no interaction between regions of the air-knife in the manner illustrated in FIGS. 9 to 12 before the airflow strikes the hand, and thus no focused drying effect on the sides of the hands. This explains why there is no high-velocity localised jet of air observed in FIG. 8. Instead, the airflow speed around the nozzle is generally uniform at the point of impact across the surface of the user's hand.

The velocity of the airflow directed on to the sides of the hands in discharge outlet shown in FIG. 13 could obviously be increased by increasing the pressure behind the slot, but this would necessarily increase the airflow velocities along the entire slot, which would come at an energy cost. The geometry of the discharge outlet in FIG. 13 does not provide for the type of flow profile incorporating high-velocity, localised jets of air targeting the sides of the hand in accordance with the invention.

The flow profile of the discharge slot in accordance with the invention is dependent upon both the radius of curvature—or 'focal length'—of the curved end and the angle subtended by the curved end. This is illustrated in FIGS. 14 to 17.

Figure 14:
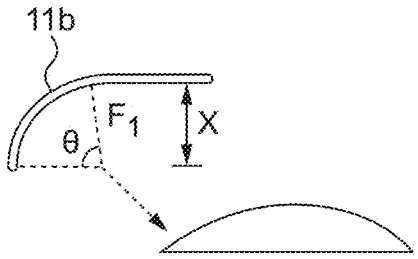
FIG. 14 is a schematic view of one end of a discharge nozzle in accordance with the invention, having a focal length $F_1$.
Figure 15:
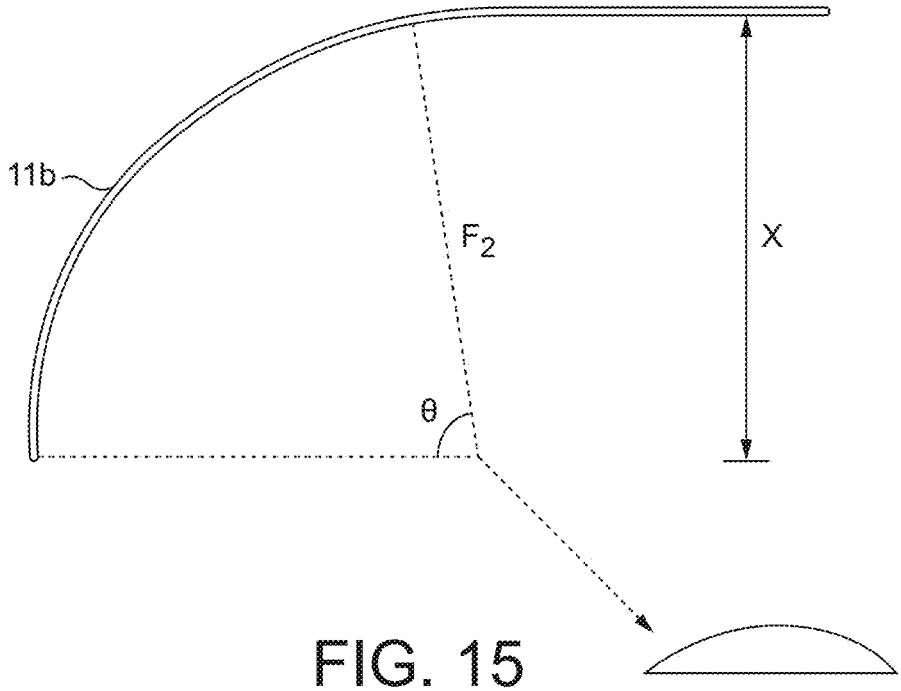
FIG. 15 is a schematic view of one end of a discharge nozzle in accordance with the invention, having a focal length $F_2$.

FIGS. 14 and 15 illustrate the effect of focal length. In FIG. 14 the focal length $F_1$ is relatively short. In FIG. 15 the focal length $F_2$ is relatively long. The angle θ subtended by the curved end part is generally the same in each case. These Figures illustrate then that, for a given angle θ, the focal length determines the minimum operational distance X between the surface of the user's hand and the discharge outlet. In simple terms, the distance X will increase as the focal length F increases.

For very long focal lengths—and consequently a large operational distance X—there may be a broadband reduction in the effectiveness of the air-knife to dry the user's hand: the air-knife will diffuse over distance. Nonetheless, the same essential flow profile characteristics will remain in accordance with the invention as they do for short focal lengths: there will still be a relatively high-velocity airflow targeting the side of the hand and a relatively low-velocity airflow targeting the face of the user's hand.

A preferred radius of curvature/focal length is considered to be in the range 5-50 mm, preferably 15-30 mm.

Figure 16:
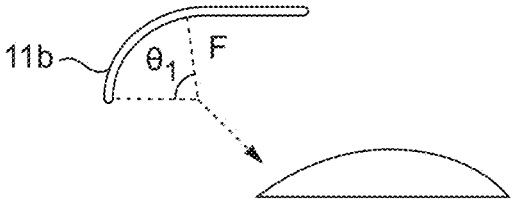
FIG. 16 is a schematic view of one end of a discharge nozzle in accordance with the invention, in which the curved end part subtends an angle $\theta_1$.
Figure 17:
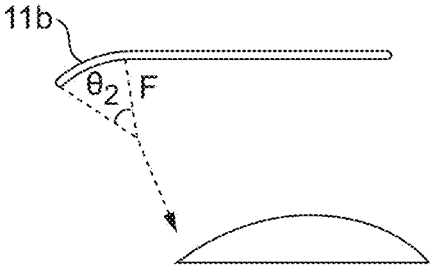
FIG. 17 is a schematic view of one end of a discharge nozzle in accordance with the invention, in which the curved end part subtends an angle $\theta_2$.

FIGS. 16 and 17 illustrate the effect of the angle θ subtended by the curved end. In FIG. 16 the angle $\theta_1$ is relatively large. In FIG. 17 the angle $\theta_2$ is relatively small. The focal length of the curved end is generally the same in each case. These figures illustrate then that, for a given focal length, F, the angle subtended by the curved end 11*b* determines the angle of attack β of the high velocity jet of air. A larger angle will produce a shallower angle of attack.

A preferred angle θ is considered to be in the range 45-90°.

The curved end sections 11*b*, 13*b* extend at least part way around the respective sides of the user's hand in use: one around the side of the hand where the thumb is located and the other around the opposite side of the hand. The overall length of the nozzle—being the distance Y between the curved ends 11*b*, 13*b* (see FIG. 6)—has been found to have an effect on the way in which the user holds his or her hand in use. Thus, if the overall length of the nozzle is controlled so that it is in the range 100 mm to 150 mm then it has been found that the user is encouraged to hold his or her hands in a more closed position—with the fingers together rather than splayed open—and that this promotes a more efficient drying action.

Although the invention is described in the context of a one-sided air-knife dryer, the invention is applicable also to two-sided air-knife hand dryers such as the one described in UK Patent No. GB2428569. In this context, the discharge outlet may be used on one side only (and thus in combination with a conventional nozzle on the opposite side) or, preferably, on both sides.

The discharge outlet need not be a continuous slot. For example, it may instead be formed by a series of closely-spaced holes, as is known in the art. What is essential is that the discharge outlet is capable of discharging an air-knife in the sense meant in this specification: a fast-moving (>80 m/s) sheet or curtain of air.

The invention claimed is:

1. A hand dryer, the hand dryer comprising a nozzle, the nozzle comprising an elongate air-knife discharge outlet for discharging an air-knife across the width of a user's hand held flat in front of the outlet, thereby mechanically to scrape water from the hand as the hand is moved lengthwise relative to the air-knife, the elongate air-knife discharge outlet of the nozzle comprising a straight part for facing a palm or back of the user's hand and a curved wrap-around end part for extending at least part way around a side of the user's hand, wherein the straight part of the elongate air-knife discharge outlet discharges air in a first direction and the curved wrap-around end part of the elongate air-knife discharge outlet discharges air in at least a second direction that converges with the air from the straight part in the first direction.

2. The hand dryer of claim 1, wherein the elongate air-knife discharge outlet of the nozzle comprises two curved wrap-around end parts: one at each end of the straight part of the elongate air-knife discharge outlet nozzle.

3. The hand dryer of claim 2, in which the overall length of the nozzle, measured between the curved ends, is between 100 and 150 mm for encouraging the user to hold the fingers of the hand closer together rather than splayed open.

4. The hand dryer of claim 1, in which the elongate discharge outlet is a continuous slot less than 1 mm in width.

5. The hand dryer of claim 1, in which a radius of curvature of the curved end part of the nozzle is in the range 5-50 mm.

6. The hand dryer of claim 1, in which an angle subtended by the curved end part of the nozzle is in the range 45-90 degrees.

7. The hand dryer of claim 1, in which two such nozzles are provided, one for each hand.

8. The hand dryer of claim 7, in which the elongate air-knife discharge outlets of each of the two nozzles are arranged in a V-configuration, when viewed from the front of the hand dryer.

* * * * *